United States Patent [19]

Herman et al.

[11] 3,983,583

[45] Oct. 5, 1976

[54] PORTABLE WET BAR

[75] Inventors: Ben Herman, Morton Grove; Jules Gould, Niles, both of Ill.

[73] Assignee: Marnel Laminates, Inc., Evanston, Ill.

[22] Filed: Nov. 14, 1974

[21] Appl. No.: 523,669

[52] U.S. Cl. ..... 4/167; 62/331; 62/340; 312/228; 312/236; 312/140.2

[51] Int. Cl.[2] ..... A47K 1/04

[58] Field of Search ..... 4/166, 167, 168, 159, 4/170; 312/140.1, 140.2, 228, 295, 236, 237; 62/331, 340; 126/37 R; 296/22

[56] References Cited

UNITED STATES PATENTS

| | | | |
|---|---|---|---|
| 1,862,654 | 6/1932 | Booth | 312/140.1 |
| 1,885,092 | 10/1932 | Fellerman | 312/140.1 |
| 2,122,042 | 6/1938 | Mattucci | 312/140.2 |
| 2,725,274 | 11/1955 | Stivale | 312/140.2 |
| 3,289,664 | 12/1966 | Hewitt | 312/236 |
| 3,748,437 | 7/1973 | Keeshin | 312/228 |
| 3,750,420 | 8/1973 | Webb | 62/331 |

FOREIGN PATENTS OR APPLICATIONS

| | | | |
|---|---|---|---|
| 721,891 | 11/1965 | Canada | 4/167 |

*Primary Examiner*—Harry N. Haroian
*Attorney, Agent, or Firm*—Laff, Whitesel & Rockman

[57] ABSTRACT

A portable wet bar having a removable top which exposes counter space beneath the top. The counter space includes a sink with a source of water and a drain, an ice bucket, and a cutting board. Beneath the counter top are a refrigerator, a water container and a waste receptacle. A single pipe goes to the faucet within the sink and the automatic ice-maker within the refrigerator.

1 Claim, 9 Drawing Figures

PORTABLE WET BAR

This invention relates to wet bars, and more particularly to portable wet bars with tops removable to disclose additional counter space.

As the suburbs have grown, people have turned to buying articles for the home and executive offices which can be used frequently and socially. People have bought new games, cars, and other luxury items. Homes are being built with built-in bars, along with many other built-ins. Office buildings constructed today do not furnish water except in the washrooms.

However, having a built-in bar is not always advantageous. Usually, while such bars may provide ice, water and drain facilities, such bars are usually in an alcove or away from the area where they can be more accessible to use.

A stationary wet bar requires permanent plumbing for the ingress of water and the egress of waste. It also requires counter space wherein one can prepare drinks or prepare and keep foods and accessories usually associated with drinks. When a bar facility is built into a den or family room, much space is required which could be used for other purposes. Additionally, permanent wet bars are usually within easy reach of children, and may present safety hazzards if glass or knives are stored therein. Thus, there is a need for a movable wet bar with decreased space requirements and having improved safety characteristics.

Accordingly, an object of this invention is to provide a portable wet bar with decreased space requirements.

Another object of the invention is to provide a portable wet bar having a source for the ingress of water and egress of waste, without requiring attachment to permanent plumbing.

Yet another object of the present invention is to provide a portable wet bar having a removable top which opens to expose additional counter or working space.

An additional object of the invention is to provide a wet bar which includes refrigeration and icemaking facilities adapted to be plugged into any electrical outlet, permitting movement inside and adjacent a house or other building.

A further object of the present invention is to provide a portable wet bar with improved safety characteristics. Specifically, an object is to provide a portable wet bar having all the necessary glass and instruments within the wet bar cabinet, thereby not having anything exposed.

In keeping with an object of this invention, the subject portable wet bar includes a removable top which exposes counter space beneath the top. In several embodiments of the invention, the top may itself be disposed so as to provide additional counter space or working surface. The portable wet bar is a self-contained unit, having a sink, faucet, bucket and cutting board provided in the counter space, and a refrigeration unit, water supply bottle and waste disposal receptacle located beneath the counter top. The refrigeration unit preferably includes icemaking capabilities, with water being furnished from the same source which supplies the faucet. The water supply and waste system is completely self-contained in the bar. The only outside connection required is an electrical source for the refrigeration equipment and water pump.

The nature of the preferred embodiments of the invention may be understood best from a study of the attached drawings wherein.

Figure 1:
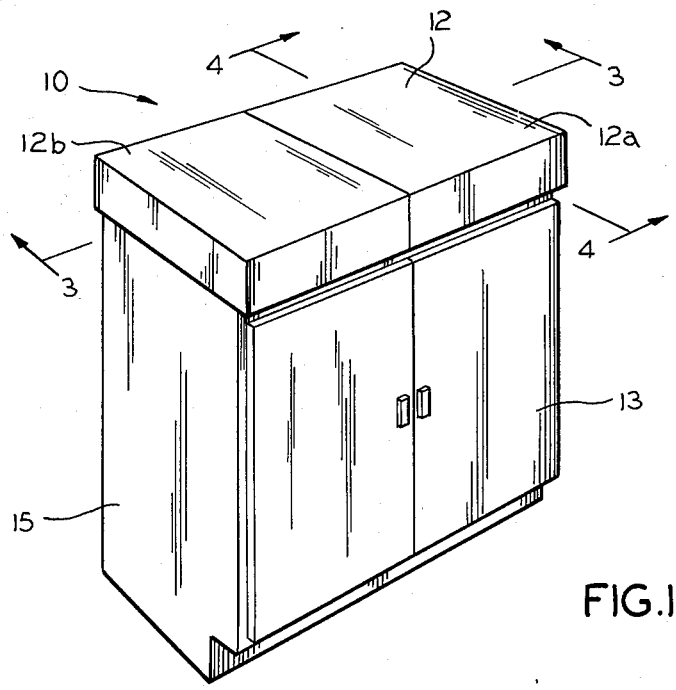
FIG. 1 is a perspective view of the inventive portable wet bar shown with the top and front in a closed position.
Figure 2:
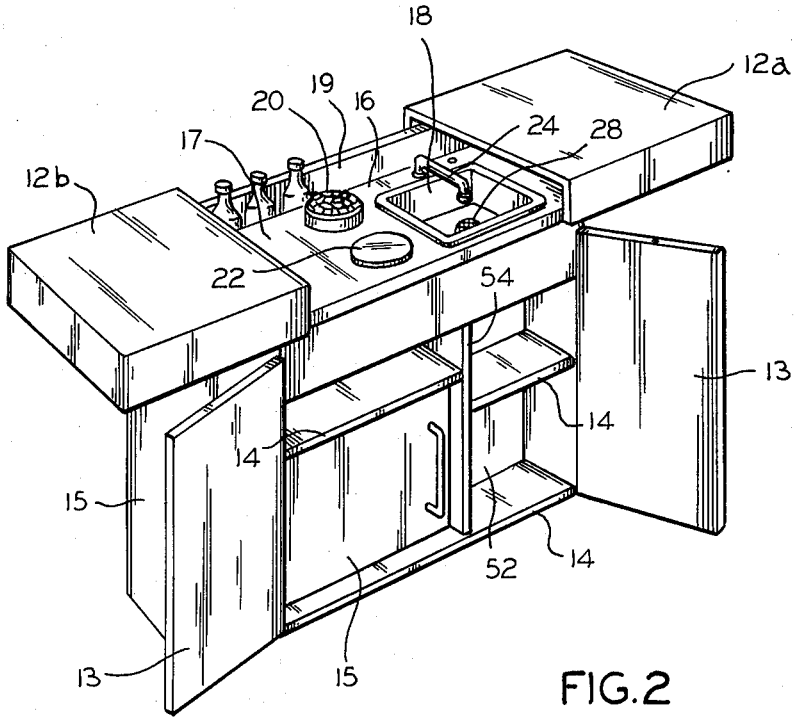
FIG. 2 is a perspective view of the inventive portable wet bar as in use with the top and front in an open position.

Referring to FIGS. 1 and 2, there is shown a portable wet bar, designated generally by the numeral 10, built in accordance with the present invention. The wet bar 10 has a top 12 having right and left hand parts **12*a* and 12*b*, and doors 13. The top 12 and doors 13 remain closed when the bar 10 is not in use, thereby concealing the contents of the bar and providing a decorative piece of furniture. The sides of the bar are designated by the numeral 15**.

The top 12 is a two positional unit depending on the purpose to be served. In the first position it is closed on top of the counter space 16, and in the second position is moved to expose additional counter space 16 located in the cabinet 10 beneath top 12. The cabinet 10 also includes internal shelves 14 (FIGS. 2, 3) which are made accessible by opening doors 13. Located on the bottommost shelf is a refrigerator 15, which preferably is electrically operated Built into the counter space 16 are basin means such as sink 18, ice retention means such as bucket 20, and cutting board means such as the circular cutting board 22 (FIG. 2, 3). Additional working space, such as for mixing drinks, is provided by surface area 17. In the embodiment of the invention illustrated in FIGS. 2 and 5, a recess 19 may be provided to store bottled beverages or the like.

Figure 4:
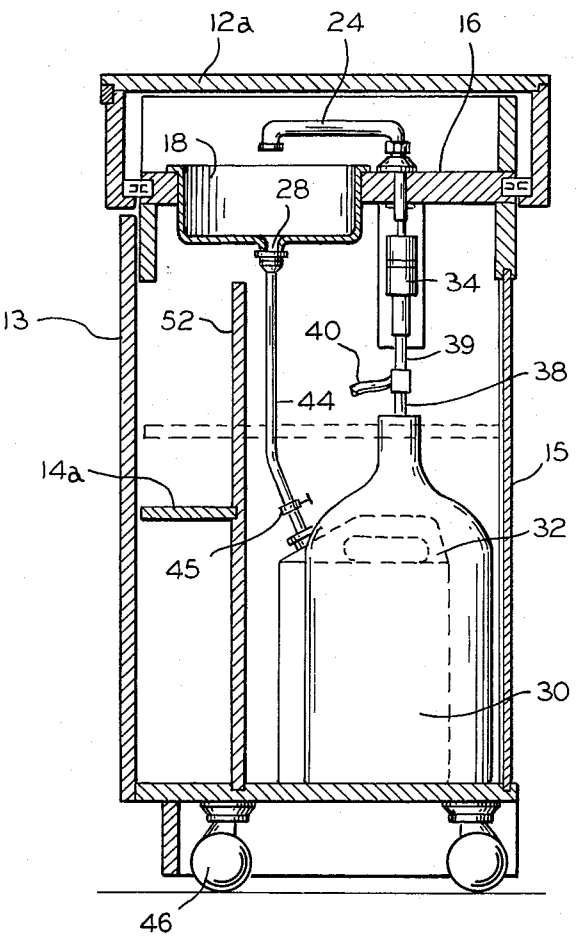
FIG. 4 is a cross-sectional view of the inventive portable wet bar taken on line 4—4 of FIG. 1.
Figure 3:
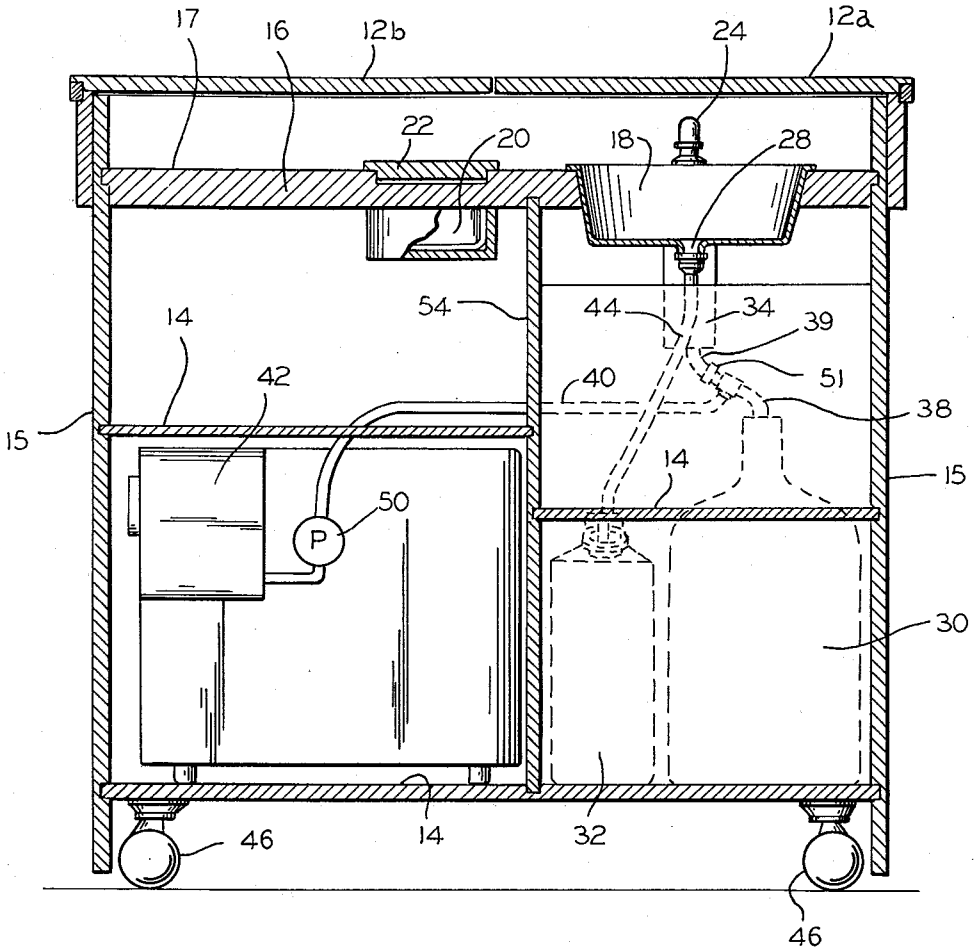
FIG. 3 is a cross-sectional view of the inventive portable wet bar taken on line 3—3 of FIG. 1.

The sink 18 includes in conjunction therewith, a faucet 24, a water flow control means such as button 26, and a drain 28. As best seen in FIGS. 3 and 4, water is delivered to faucet 24 from a water supply means such as bottle 30 of purified water through conduit means or pipe 38. Pipe 38 extends into two branches, first pipe 39 and second pipe 40. First pipe 39 connects the faucet 24 to the bottle 30, while second pipe 40 connects pipe 38 to the pump 50 associated with automatic ice maker means 42 in refrigeration unit 15.

Located in first pipe 39 is an electrically operated pump 34 for pumping water from bottle 30 to faucet 24. Pump 34 is manually operated by pushing control button 26, which is located on counter top 16 adjacent faucet 24. Any water or waste poured into sink 18 is carried from drain 28 by means of a water pipe 44 to waste disposal means such as jerry can 32. When bottle 30 is empty, it may be replaced with a full bottle through an opening in the rear of bar 10. Likewise, waste can 32 may be removed when full from the same opening, emptied, and replaced. A shut-off valve 45, controlled by a stop-cock, is provided to prevent waste material from draining from pipe 44 when jerry can 32 is removed. The portable wet bar 10 is movable about on wheels 46, providing liquid refreshment at any convenient location.

The refrigerator 15 is provided with a freezer section having an automatic icemaker 42. The icemaker is connected by pipe 40 to the water supply in bottle 30, so that water is pumped from bottle 30 to icemaker 42, on demand, by pump 50. The wet bar 10, when in use, is connected to an electric outlet by means of a plug (not shown) extending from the wet bar 10 to a wall electric outlet. Pump 34 and refrigerator 15 are suitably connected internally to the plug extending from the wet bar. Valve control 51 is provided in line 39 to automatically shut off faucet 24 when refrigerator pump 50 signals a demand for water.

Adequate storage area is provided by shelves 14 in wet bar 10 for storing containers of liquids, such as refreshments and mixers, as well as food and bar accessories as needed to compliment the bar facility. Median shelf 14*a* (FIG. 4) is mounted on a divider panel 52 (FIG. 5) which extends across the bar 10 in front of bottle 30 and waste can 32, and behind refrigerator 15. Thus, the front door of refrigerator 15 is readily accessible when doors 13 are open, while bottle 30 and waste can 32 are maintained out of sight by panel 52. As stated previously, bottle 30 and waste can 32 may be inserted in and removed from bar 10 by means of an opening in the rear of the bar. A vertically disposed divider panel 54 (FIG. 3) is located in the bar to separate the refrigerator compartment from the water supply and waste compartment.

Figure 5:
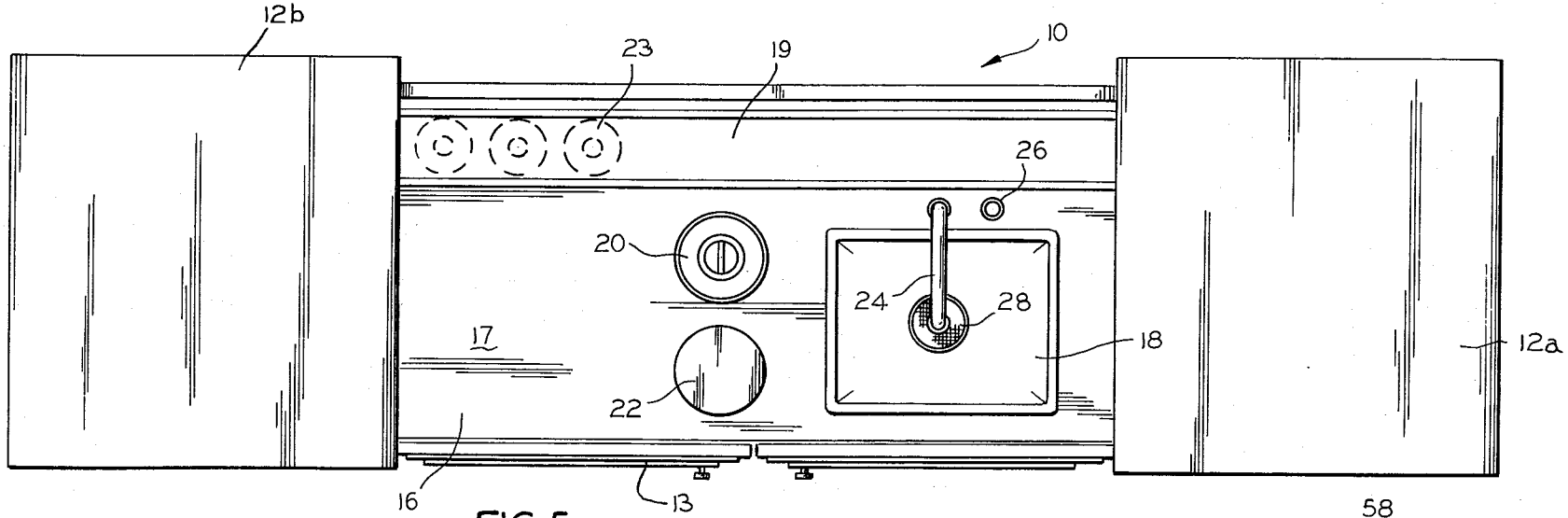
FIG. 5 is a plan view of the wet bar in use, illustrating one embodiment, namely a sliding counter top cover.

An additional novel feature of the portable wet bar 10 is disclosed in FIGS. 2, 5 and 6A–6D. The top 12 of the portable wet bar 10 may be attached in several different ways to provide additional counter space. FIGS. 2 and 5 disclose slidable counter covers 12*a*, *b* which are adapted to cover or uncover counter top 16. When the covers 12*a*, *b* are in the position shown in FIG. 2, the amount of workable space is doubled.

Figure 6C:
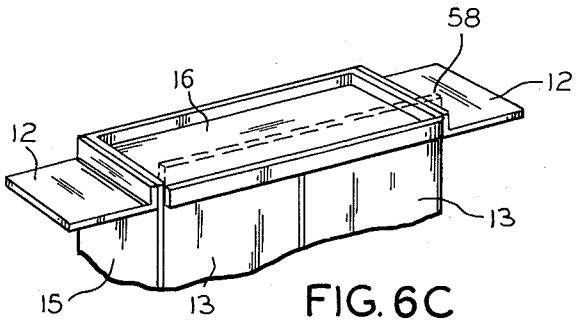
FIGS. 6A–6D are different embodiments of the wet bar showing various modes of operation of the counter top cover of the inventive wet bar.
Figure 6D:
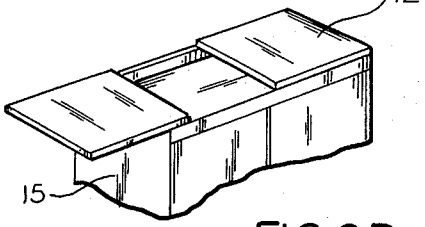
Figure 6B:
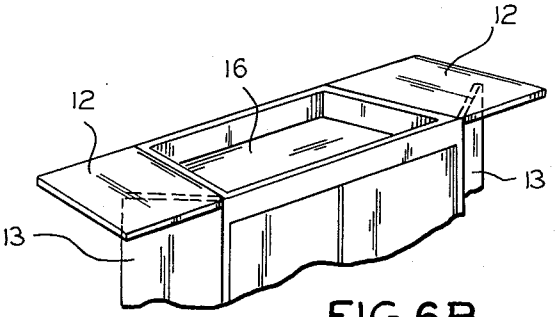
Figure 6A:
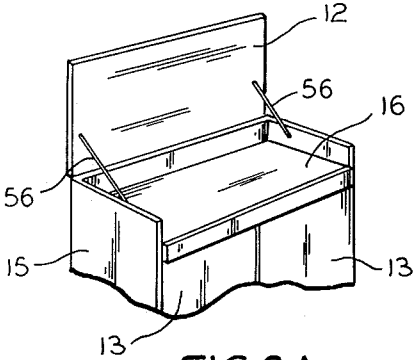

FIGS. 6A–6D disclose various embodiments of the invention, with the top 12 pivotally attached to the sides 15 of bar 10. FIG. 6A discloses the top 12 hinged to the rear side of the bar 10, whereby the top pivots upward to uncover counter top 16. The pivotal movement of top 12 is limited by chains 56 to prevent the top from hitting an adjacent object. FIG. 6B shows hinged tops 12 supported by the doors 13, FIG. 6C shows a top 12 having a downward depression and means 58 disposed beneath the tops 12 to support the tops. FIG. 6D shows a self supporting top which is hinged at a distance inward from the edge of the bar. All the tops 12, however, do one particular thing; they provide increased counter space when needed, and provide a covering for counter top 16 of the wet bar when not in use.

In operation, the wet bar 10 provides a convenient unit for use at any time and uses only a minimum of space. Everything required for the bar may be stored within the unit itself. Liquor or other bottles may be stored in bottle holders 23, glasses and other necessities on shelves 14 or in recess 19 as shown in the embodiment of FIG. 2, and ice in ice bucket 20.

To pump water on demand from bottle 30 to faucet 24, button 26 is pushed to actuate the electric motor operating pump 34. Water is conveyed from bottle 30 through pipes 38 and 39, and through faucet 24. The water, after use, passes through drain 28, pipe 44 and into waste can 32.

Those who are skilled in the art will readily perceive modifications which may be made in this invention. Therefore, the appended claims are to be construed to cover all equivalent structures falling within the true scope and spirit of the invention.

I claim:

1. A portable wet bar comprising:

a cabinet;

said cabinet having a top and sides;

said top being removable to expose counter space beneath said top;

water supply means and waste receiving means disposed beneath said counter space within said cabinet;

basin means in said counter space, said basin means including faucet means;

first pump means including a connection between said water supply means and said faucet means to convey said water upon demand from said water supply means to said basin means; and said basin means including a drain connecting said basin to said waste water receiving means;

refrigeration means disposed in said cabinet;

said refrigeration means including automatic icemaker means;

water conduit means connected between said connections and said refrigeration means to convey water from said water supply means to said icemaker means;

said conduit means including second pump means to control the flow of water from said supply means to said icemaker means; and said connection between said first pump means and said water supply means including second conduit means extending between said first pump means and said water supply means.

* * * * *